US006206538B1

(12) United States Patent
Lemoine

(10) Patent No.: US 6,206,538 B1
(45) Date of Patent: Mar. 27, 2001

(54) MISER LIGHT FOR CORDLESS BATTERY OPERATED HAND TOOLS

(76) Inventor: David B. Lemoine, 5330 DeSiard St., #23, Monroe, LA (US) 71203

( * ) Notice: Subject to any disclaimer, the term of this patent is extended or adjusted under 35 U.S.C. 154(b) by 0 days.

(21) Appl. No.: 09/385,517

(22) Filed: Aug. 30, 1999

(51) Int. Cl.[7] ..... B25B 23/18

(52) U.S. Cl. ..... 362/119; 362/89; 362/394; 307/132 R

(58) Field of Search ..... 362/119, 120, 362/394, 89, 118, 96; 307/132 R, 139; 15/320

(56) References Cited

U.S. PATENT DOCUMENTS

| | | | |
|---|---|---|---|
| 2,310,166 | 2/1943 | Way | 362/119 |
| 2,517,882 | 8/1950 | Johnson | 173/46 |
| 2,525,588 | 10/1950 | Cameron | 362/119 |
| 5,169,225 | 12/1992 | Palm | 362/118 |
| 5,267,129 | 11/1993 | Anderson | 362/96 |
| 5,412,546 | 5/1995 | Huang | 362/119 |
| 5,793,130 | 8/1998 | Anderson | 310/50 |
| 5,797,670 | 8/1998 | Smoke | 362/119 |
| 6,092,260 * | 7/2000 | Kai | 15/320 |

* cited by examiner

*Primary Examiner*—Stephen Husar
*Assistant Examiner*—Hargobind S. Sawhney

(57) ABSTRACT

This invention provides a means to selectively, by single finger pressure of one hand on the operating switch of a cordless battery operated hand tool, turn the illumination of the work area on when required by the operator of the tool, then, by further finger pressure on the operating switch, turn the tool motor on and/or turn the light source off, and by releasing finger pressure on the operating switch, turn both illumination and the tool motor off. Thus battery discharge is controlled by one-handed single finger pressure on the operating switch of the tool, and is automatically terminated when the tool is not in use, conserving battery charge. The gist of the invention is the adaptation of a "Make-Before-Break" switch to the operating switch of the tool, which is usually configured as a spring return trigger operated "On/Off" switch housed in a pistol style grip for hand tools. The invention is, however, easily adapted to and may be readily incorporated on or in other types of tool operating switches, such as, but not limited to, toggle switches, push button switches, multiple pole switches, plunger switches, knife switches and the like.

1 Claim, 4 Drawing Sheets

MISER LIGHT FOR CORDLESS BATTERY OPERATED HAND TOOLS

CROSS REFERENCES TO RELATED APPLICATIONS

None

STATEMENT AS TO RIGHTS TO INVENTIONS MADE UNDER FEDERALLY SPONSORED RESEARCH AND DEVELOPMENT

None

BACKGROUND

1. Field

Cordless battery operated hand tools

2. Description of the Background

This invention relates to cordless battery operated hand tools, and more particularly to such tools having or needing to have embodied therein lighting systems adapted to illuminate the field of operation of the tools.

A cordless battery operated drill driver is a good example of a tool in which the invention advantageously may be embodied, and therefore, for convenience, the invention will be shown and described in connection with that specific type of cordless battery operated tool.

Equipping various forms of electrically operated hand tools with illumination is not new, however it has always been accomplished by providing a separate circuit off the main power source that has to be independently operated. This invariably has led to battery drain when the operator forgets to turn the illumination off, and premature re-charging of batteries when battery charge has been exhausted because of excessive illumination operation. Frequently, in both high and low ambient light conditions, the operator of the hand tool forgets that the light is still on, and puts it away with the light still glowing, with consequent battery drain.

All of the existing designs require that the operator of the hand tool hold the tool with one hand, while operating the illumination switch with the other hand. This is a two handed requirement that leaves no hand to hold the object being operated on by the tool.

Moreover, there is presently no battery operated hand tool with the capability of illuminating the work area that automatically turns the source of power to the illumination off when the tool is not in use.

The deficiencies above noted in present day approaches were not eliminated or avoided because none of the earlier approaches recognized or were able to discern the unique combination of elements and interrelationships of the present invention which is briefly outlined in the following Summary, more fully described in the following Detailed Description and which is defined by the following Claims.

SUMMARY

This invention provides a means to selectively, by single finger pressure of one hand on the operating switch of a cordless battery operated hand tool, turn the illumination of the work area on when required by the operator of the tool, then, by further finger pressure on the operating switch, turn the tool motor on and/or turn the light source off, and by releasing finger pressure on the operating switch, turn both illumination and the tool motor off. Thus battery discharge is controlled by one-handed single finger pressure on the operating switch of the tool, and is automatically terminated when the tool is not in use, conserving battery charge. The gist of the invention is the adaptation of a "Make-Before-BreaK" switch to the operating switch of the tool, which is usually configured as a spring return trigger operated "On/Off" switch housed in a pistol style grip for hand tools. The invention is, however, easily adapted to and may be readily incorporated in other types of tool operating switches, such as, but not limited to, toggle switches, push button switches, multiple pole switches, plunger switches, knife switches and the like.

Upon initial depression of the "Make-Before-Break" switch (which is affixed to and part of the trigger switch assembly) by the operator of the tool using a single finger, the light is illuminated with energy from the tool battery. Further pressure using the same finger on the switch results in "making" the second circuit, also fed by the same battery, energizing the tool motor, while the light is still illuminated. Finally, depressing the switch past the position where the light is illuminated turns the light off, while the tool motor continues to run. Thus the operator has complete selective control using a single finger both over illumination and operation of the tool itself, freeing the other hand of the operator during operation of the tool.

Then, when operation of the tool is completed and finger pressure has been removed from the operating switch, all power is automatically switched off, both to the tool motor and to the source of illumination, thus conserving battery charge without any required intentional "turn off" by the operator.

A separate single pole, single throw switch disables the light source completely when illumination is not required or desired.

With the above features in mind, the invention comprises the devices, combinations and arrangements of parts hereinafter set forth and illustrated in the accompanying drawings of a preferred embodiment of the invention, from which the several features of the invention and the advantages attained thereby will be readily understood by those skilled in the art.

BRIEF DESCRIPTION OF THE DRAWINGS

FIG. 2 is a side view, and FIG. 3 is a top view.

DETAILED DESCRIPTION

Figure 1:
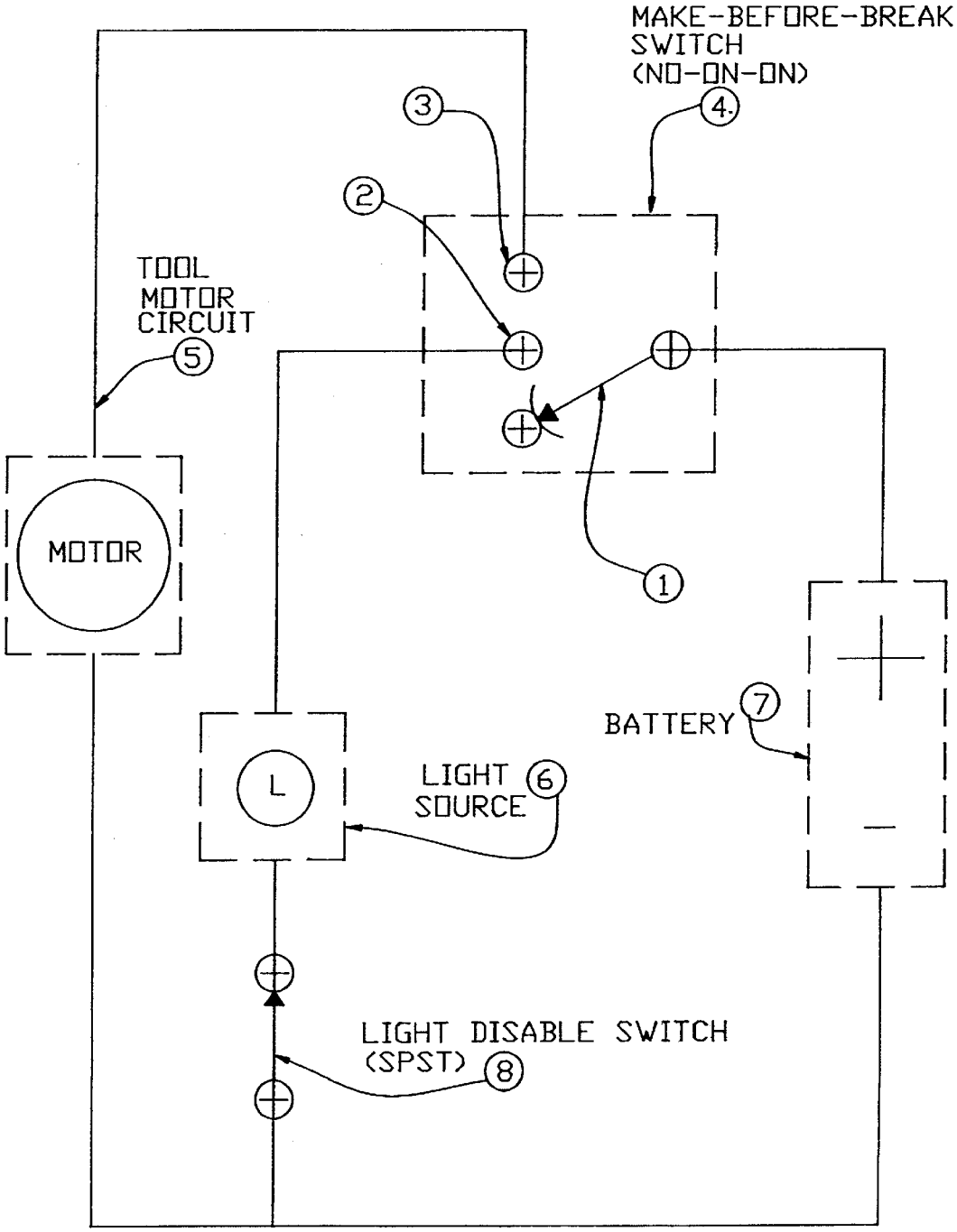
FIG. 1 is a schematic drawing of the electrical circuit showing how the light source is wired in parallel with the tool motor, as well as how the "Make-Before-Break" switch is configured.

Referring more specifically to the drawings, the invention is disclosed as embodied in a cordless battery operated drill driver having a spring return trigger switch assembly to initiate operation of the drill driver. The casing 15 of the drill driver houses the tool battery 7, an electric motor 5, and the necessary circuitry to control operation of the electric motor 5, and includes the spring 14 return trigger switch assembly 13. The "Make-Before-Break" switch 4 consists of an electrical contact 1, configured so as to have sufficient length and width as needed to span the distance between two stationary electrical contacts 2 and 3.

This movable contact 1 is attached to the shaft of the trigger 9, such that when the trigger 9 is depressed the contact 1 attached to the shaft 12 slides to make contact with the first of the two stationary contacts 2. This is the first "ON" position of the switch 4, enabling current to pass from the battery 7 through the light source 6.

When the trigger 9 is further depressed, the contact attached to the shaft 1 slides to make contact with both the first 2 and second 3 stationary contacts, energizing both the tool motor circuit 5 and the light source 6.

When the trigger 9 is depressed all the way, the contact attached to the shaft 1 breaks touch with the first stationary contact 2, interrupting the flow of current to the light source 6, while maintaining the flow of current to the tool motor circuit 5.

The trigger shaft 9 may be configured with detents 10 and 11 for each trigger position to enable the operator to maintain trigger position for each mode of operation. No detent would be required for the fully depressed position of the trigger, when only the tool motor circuit is energized, however. Similarly, no detent is required for the normally off position of the trigger.

Figure 3:
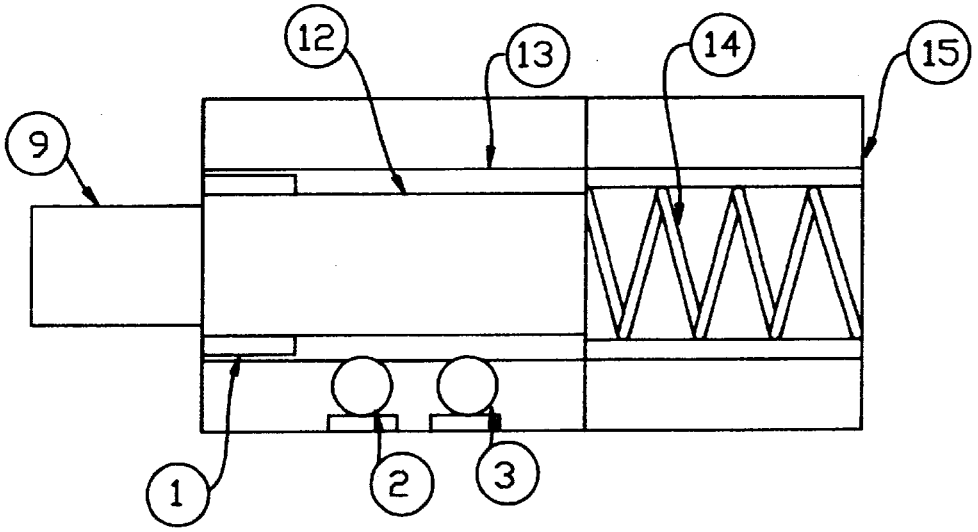
FIGS. 2 and 3 are not to scale line drawings of the trigger switch showing a suggested method of attaching the "Make-Before-Break" switch to the trigger assembly of a drill driver tool.
Figure 2:
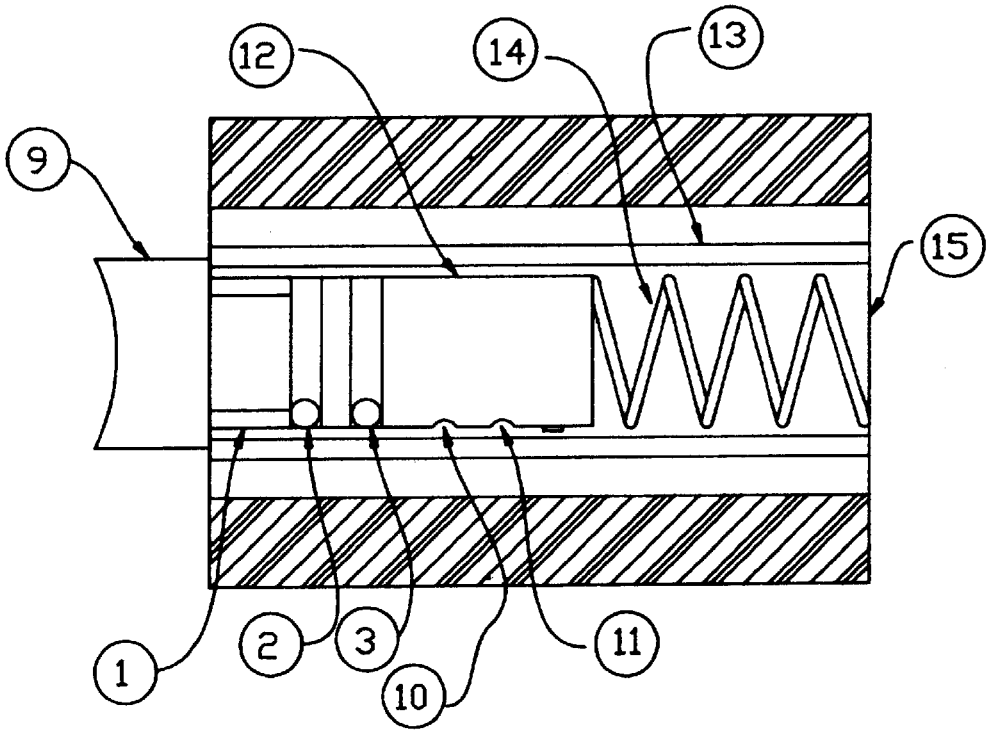
Figure 4:
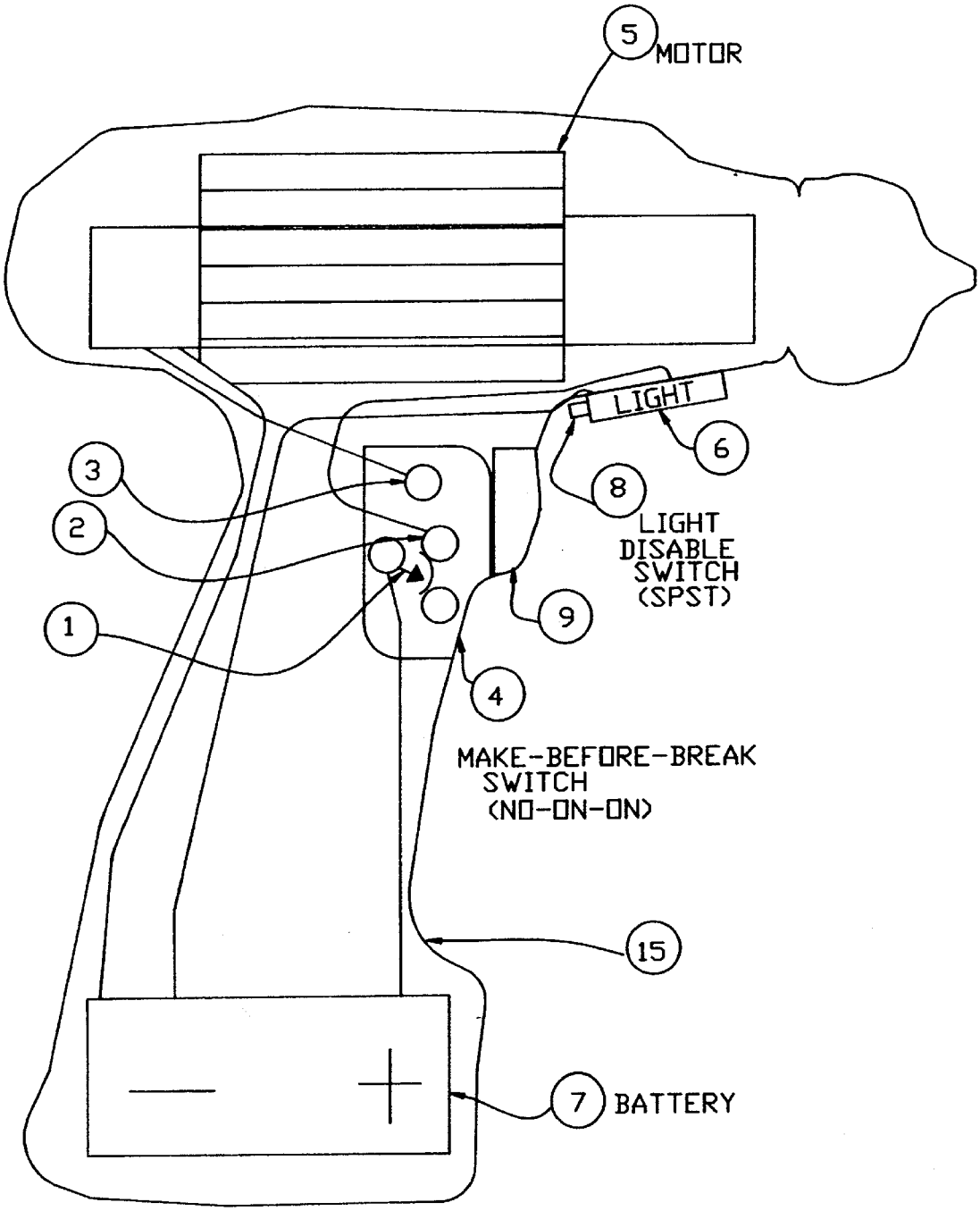
FIG. 4 is a not to scale line drawing of a drill driver tool with one side of the case removed depicting a preferred location of the light source assembly and configuration of the "Make-Before-Break" switch.
Figure 5:
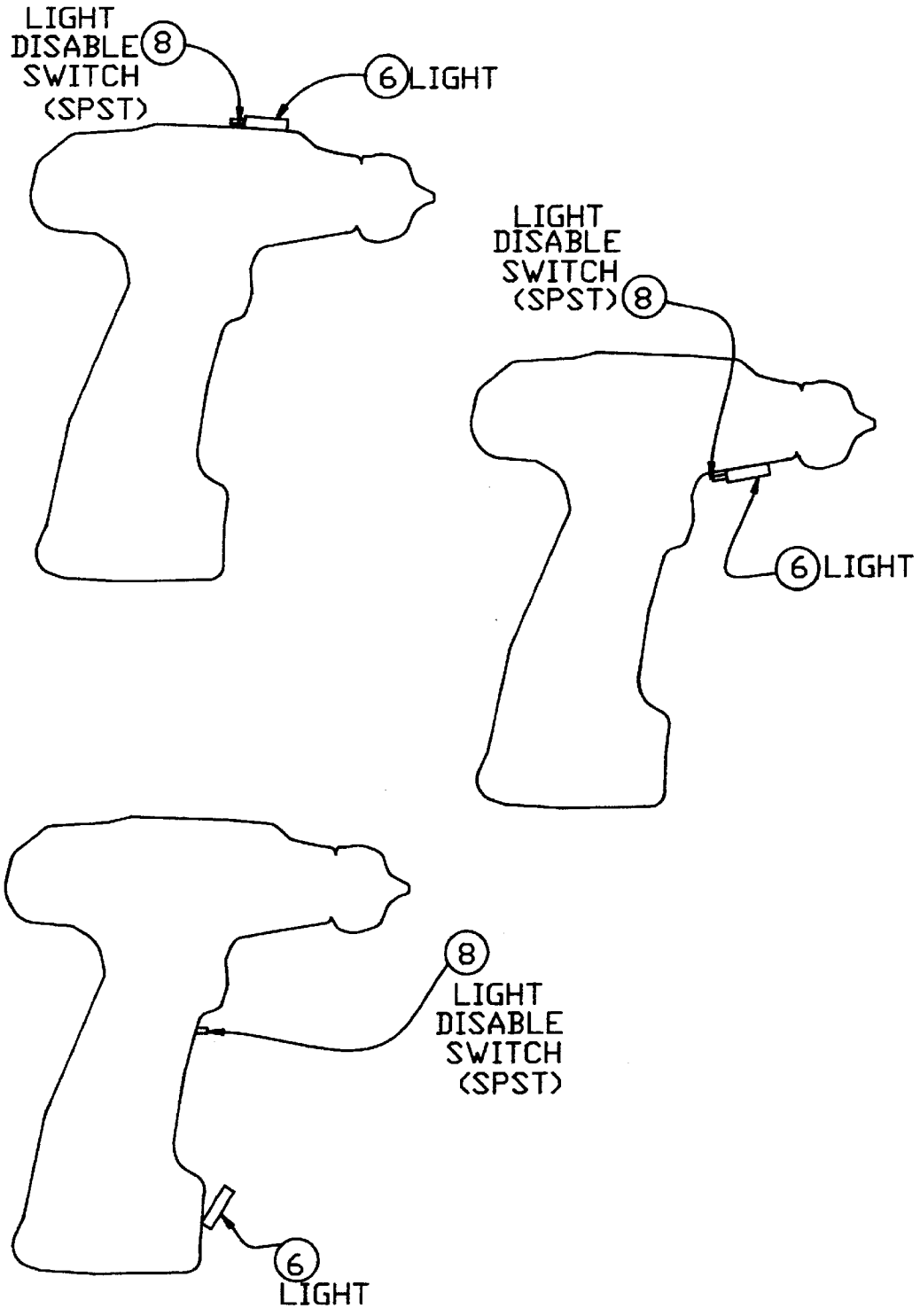
FIG. 5 depicts various suggested locations of the light source and light-disabling switch on a drill driver tool

A separate single pole single throw switch 8 is conveniently located such that the switch can also be operated by the trigger finger of the operator to enable and disable the light source 6. Suggested positions for this switch are depicted in FIG. 3.

The light source 6 may be an incandescent, halogen, or similar source of light matched to the output voltage of the tool battery 7.

Claims: Having thus set forth the nature of the invention, what I claim is:

1. In a light source equipped cordless battery operated hand tool, the improvement which comprises incorporation of a Make-Before-Break, (Normally Open-On-On) switch circuit, in series with a parallel configuration of the tool motor circuit and the light source circuit, that enables the operator of the hand tool selectively, and independently, with a single finger on one hand, to control a light source located on the hand tool and the tool motor, such that the light source can be turned on without having to engage the tool motor, and enables simultaneous operation of the light source and the tool motor when desired by the tool operator, as well as a mode of operation in which the light source is turned off while the tool motor remains energized; which switch circuit also automatically shuts off power to the light source and tool motor when the hand tool is not in use.

* * * * *